US006215371B1

(12) United States Patent
Kurahashi et al.

(10) Patent No.: US 6,215,371 B1
(45) Date of Patent: Apr. 10, 2001

(54) NON-RECIPROCAL CIRCUIT ELEMENT WITH A CAPACITOR BETWEEN THE SHIELD CONDUCTOR AND GROUND TO LOWER THE OPERATING FREQUENCY

(75) Inventors: Takahide Kurahashi; Hidenori Ohata; Akihito Watanabe; Yoshinori Matsumaru, all of Chiba (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/341,672

(22) PCT Filed: Nov. 11, 1998

(86) PCT No.: PCT/JP98/05103

§ 371 Date: Jul. 16, 1999

§ 102(e) Date: Jul. 16, 1999

(87) PCT Pub. No.: WO99/30382

PCT Pub. Date: Jun. 17, 1999

(30) Foreign Application Priority Data

Dec. 8, 1997 (JP) ..... 9-352011
Jan. 22, 1998 (JP) ..... 10-024079

(51) Int. Cl.[7] ..... H01P 1/387
(52) U.S. Cl. ..... 333/1.1; 333/24.2
(58) Field of Search ..... 333/1.1, 24.2

(56) References Cited

U.S. PATENT DOCUMENTS 3,517,340 * 6/1970 Magalhaes ..... 333/1.1
3,605,040 9/1971 Knerr et al. ..... 333/1.1
3,836,874 * 9/1974 Maeda et al. ..... 333/1.1
3,890,582 * 6/1975 Jeong ..... 333/1.1 X
4,174,506 * 11/1979 Ogawa ..... 333/1.1
4,258,339 * 3/1981 Bernard et al. ..... 333/1.1
4,812,787 * 3/1989 Kuramoto et al. ..... 333/1.1
5,900,789 * 5/1999 Yamamoto et al. ..... 333/1.1
6,020,793 * 2/2000 Makino et al. ..... 333/1.1

FOREIGN PATENT DOCUMENTS 49-5547 1/1974 (JP) .
49-28219 7/1974 (JP) .
50-9661 4/1975 (JP) .
56-123624 9/1981 (JP) .
6-338707 12/1994 (JP) .

OTHER PUBLICATIONS

"A Compact Broad–Band Thin–Film Lumped–Element L–Band Circulator", Knerr et al, *IEEE Transactions on Microwave Theory and Techniques*, vol. MTT–18, No. 12, Dec. 1970, pp. 1100–1108.

* cited by examiner

*Primary Examiner*—Justin P. Bettendorf
(74) *Attorney, Agent, or Firm*—Arent Fox Kintner Plotkin & Kahn, PLLC

(57) ABSTRACT

A non-reciprocal circuit element includes a plurality of inner conductors intersecting with keeping insulation with each other, a shield conductor connected in common to one end of the inner conductors, and a capacitor connected between the shield conductor and a ground of the non-reciprocal circuit element, for adjusting only eigen values of in-phase excitation. Thus, smaller size, lighter weight and lower height can be attained and also temperature characteristics can be optionally adjusted without changing material used and without inviting increased insertion loss.

8 Claims, 15 Drawing Sheets

Hi ; DC MAGNETIC FIELD PERPENDICULAR TO Hrf
Hrf ; ROTATING RF MAGNETIC FIELD
ROTATING SENSE OF RF MAGNETIC FIELD
FERROMAGNETIC RESONANCE
Hi
Hrf
Hrf
Hi
FERROMAGNETIC RESONANCE
SNOEK'S LIMIT
PERMEABILITY
FERROMAGNETIC RESONACE CONDITION
FREQUENCY (MHz)
2,000
400
0
60,000
40,000
20,000
0
-20,000
-40,000
INTERNAL DC MAGNETIC FIELD (AT/m)

NON-RECIPROCAL CIRCUIT ELEMENT WITH A CAPACITOR BETWEEN THE SHIELD CONDUCTOR AND GROUND TO LOWER THE OPERATING FREQUENCY

TECHNICAL FIELD

The present invention relates to a non-reciprocal circuit element used in a microwave band radio device, for example in a mobile communication device such as a portable telephone.

BACKGROUND ART

In accordance with recent downsizing of mobile communication devices, demand for downsizing of non-reciprocal circuit elements such as isolators or circulators used in the communication devices has increased.

A conventional lumped element type circulator has an assembled circulator element with a circular plane shape and a basic structure as shown in an exploded oblique view of FIG. 1.

In the figure, a reference numeral 100 denotes a circular substrate made of a non-magnetic material such as a glass-reinforced epoxy. Center conductors (inner conductors) 101 and 102 are formed on the top face and next to the bottom face of the non-magnetic material substrate 100, respectively. These inner conductors 101 and 102 are electrically connected with each other by via holes 103 passing through the substrate 100. Circularly shaped members 104 and 105 made of a ferromagnetic material are attached to the both faces of the non-magnetic material substrate 100 having the inner conductors 101 and 102 so that rotating RF (Radio Frequency) magnetic fluxes are induced In these ferromagnetic members 104 and 105 due to an RF power applied to the inner conductors 101 and 102. The conventional circulator element of the circulator has a circular plane shape and is constructed by assembling, namely piling and bonding, the ferromagnetic members 104 and 105 on the both sides of the non-magnetic material substrate 100.

The circulator as a whole is constructed, as shown in its exploded oblique view of FIG. 2, by stacking and fixing in sequence the ferromagnetic members 104 and 105, grounding conductor electrodes 106 and 107, exciting permanent magnets 108 and 109 and a metal housing separated to upper and lower parts 110 and 111 on the both side of the non-magnetic material substrate 100 having the inner conductors 101 (102), respectively. The housing parts 110 and 111 form a magnetic path of the magnetic flux from and to the exciting permanent magnets 108 and 109.

If a RF power Is applied to the inner conductors 101 and 102 through terminal circuits not shown, RF magnetic flux rotating around the inner conductors 101 and 102 will be produced In the ferromagnetic members 104 and 105. Under this state, If a dc magnetic field perpendicular to the RF magnetic flux is applied from the permanent magnets 108 and 109, the ferromagnetic members 104 and 105 present different permeability $\mu_+$ and $\mu_-$ depending upon rotating sense of the RF magnetic flux, as shown in FIG. 3. A circulator utilizes this difference of the permeability depending upon the rotating sense. Namely, a propagation velocity of the RF signal in the circulator element will differ in accordance with the rotating sense and thus the signals transmitting to the opposite directions will cancel each other, thereby preventing the propagation of the signal to a particular port.

A non-propagating port is determined in accordance with its angle against a driving port due to the permeability $\mu_+$ and $\mu_-$ of the ferromagnetic member. For example, if ports A, B and C are arranged in this order along a certain rotating sense, the port B will be determined as the non-propagating port against the driving port A and the port C will be determined as the non-propagating port against the driving port B. Terminating one port of thus arranged circulator might constitute an isolator. Termination of the port can be realized by connecting to the port a matched resistor such as a chip resistor, or a thick or thin film resistor formed on a substrate for providing a resonance capacitor.

In such non-reciprocal circuit element, the ratio of volume occupied by the permanent magnet(s) is typically larger than that of another components. This has made difficult to downsize the non-reciprocal circuit element.

Most of conventional lumped element circulators may have a structure represented by an equivalent circuit shown in FIG. 4. In this case, one end (outer conductor) 400 of each inductor of the circulator is directly connected to the ground.

Known in this field is, in order to widen frequency band of a circulator, to insert a serial resonance circuit 501 for adjusting eigen values of in-phase (equal phase) excitation between a common connection point (outer conductor) 500 to which one end of each inductor of the circulator is commonly connected and the ground, as shown in an equivalent circuit of FIG. 5.

In general, to obtain three-port circulator operation, it is necessary to keep those admittances at in-phase excitation, positive phase excitation and negative phase excitation thereof have relationship of angular difference of 120 degrees with each other. The admittances at the positive phase excitation and the negative phase excitation will generally vary depending upon frequency change but admittance at the in-phase excitation will never change. Thus, if the frequency changes greatly, it is impossible to fees the relationship of angular difference of 120 degrees in the admittances causing that circulator operation cannot be expected. As a result, the operation frequency band of the circulator is limited to a narrower band.

Contrary to this, as aforementioned, by additionally inserting the serial resonance circuit for adjusting eigen values of in-phase excitation, the relationship of angular difference of 120 degrees in the admittances can be kept for a long time resulting the operation frequency band of the circulator to widen. However, the addition of the LC serial resonance circuit results of increase in the number of components of the circulator and therefore invites difficulty of downsizing of the circulator. In addition, since it is very difficult to make a small and high-performance inductor, the LC serial resonance circuit to be added will become large in size.

Japanese Patent Publication No.49(1984)-28219 discloses a circulator with capacitors each of which is inserted between one end of each inner conductor and the grounded conductor. An equivalent circuit of this circulator is shown in FIG. 6. As will be understood from the figure, in the circulator, capacitors 601, 602 and 603 are connected to respective ends of three inner conductors. However, according to this structure, these capacitors will exert an influence upon not only eigen values of In-phase excitation but also eigen values of both positive and negative phase excitations. Therefore, as well as the conventional art shown in FIG. 4, when the frequency changes greatly, it is impossible to keep the relationship of angular difference of 120 degrees in the admittances causing that circulator operation cannot be expected. As a result, the operation frequency band of the circulator is limited to a narrower band.

Temperature characteristics of the non-reciprocal circuit element will be discussed hereinafter.

There are various factors that will effect on the temperature characteristics of a non-reciprocal circuit element such as a circulator. It is considered that the main factor is temperature characteristics of saturation magnetization in the ferromagnetic material such as YIG (yttrium iron garnet) used for the circulator element, or the temperature characteristics of the permanent magnet(s) for providing bias magnetic field. In general, change in the temperature characteristics of the ferromagnetic material such as YIG used is larger than that of the bias magnetic field. Thus, the higher the temperature of the circulator, the higher its operation frequency becomes. This causes effective frequency band to be used to become narrower. Thus, in general, gadolinium is substituted in YIG to improve the temperature characteristics of saturation magnetization in YIG. However, the substitution of gadolinium causes loss of YIG to increase and therefore invites increased insertion loss of the circulator. Also, such substitution cannot perfectly adjust the temperature characteristics.

As aforementioned, with the spread of and downsizing of recent mobile communication devices, the non-reciprocal circuit elements themselves are requested to be manufactured in smaller size, in lighter weight and in lower height. In order to satisfy these requirements, it is important to make components of the non-reciprocal circuit element, particularly permanent magnet(s), in smaller size.

The conventional art has another problem that if the non-reciprocal circuit element is made in smaller size, its operation frequency will increase and thus it is difficult to obtain a desired operation frequency.

DISCLOSURE OF INVENTION

It is therefore an object of the present invention to provide a non-reciprocal circuit element with smaller size, lighter weight and lower height by lowering operation magnetic field of the non-reciprocal circuit element to downsize its permanent magnet(s), and by lowering operation frequency.

Another object of the present invention is to provide a non-reciprocal circuit element that can be fabricated without changing material used and can optionally adjust temperature characteristics without inviting increased insertion loss.

According to the present invention, a non-reciprocal circuit element includes a capacitor connected between a shield conductor and a ground of the non-reciprocal circuit element, for adjusting only eigen values of in-phase excitation.

Also, according to the present invention, a non-reciprocal circuit element includes a plurality of inner conductors intersecting such that they remain insulated from each other, a shield conductor connected in common to one end of each of the inner conductors, and a capacitor connected between the shield conductor and a ground of the non-reciprocal circuit element, for adjusting only eigen values of in-phase excitation.

Since a capacitor is connected between a shield conductor that is commonly connected to one ends of inner conductors and a ground, for adjusting only eigen values of in-phase excitation, both center frequency of isolation and applied bias magnetic field can be simultaneously decreased. By lowering the operation frequency, a smaller sized circulator element can be used. As a result, a non-reciprocal circuit element with smaller size, lighter weight and lower height can be realized. In addition, by lowering operation magnetic field, a smaller sized permanent magnet can be used, resulting further downsizing of the non-reciprocal circuit element to realize. Furthermore, since such effects can be obtained by merely adding a capacitor, downsizing of the non-reciprocal circuit element will be expedited.

Selecting the capacitance value of this additional capacitor can optionally change the amount of frequency change per unit of magnetic field dF/dH. If dF/dH increases, the temperature characteristics of the non-reciprocal circuit element is affected more strongly by the temperature characteristics of the bias magnetic field and thus there occurs an effect as if the temperature characteristics of the bias magnetic field increases. As a result, the temperature characteristics of the circulator can be improved. The dF/dH can be optionally changed depending upon the capacitance value of the additional capacitor. Thus, the temperature characteristics of the circulator can be optionally adjusted by selecting the capacitance value. If the capacitance value is determined to an optimum value, a circulator with substantially constant temperature characteristics may be realized.

It is preferred that the additional capacitor is a capacitor with a capacitance value of Cs [pF] which satisfies $Cs \times C \leqq 1500$, where C [pF] is a parallel resonance capacitance value of the non-reciprocal circuit element. More preferably, the additional capacitor is a capacitor with a capacitance value of Cs [pF] which satisfies $Cs \times C \leqq 900$.

In an embodiment of the present invention, the inner conductors are strip lines folded on the ferromagnetic material body. In this case, the additional capacitor preferably includes the shield conductor, the ground and a resin material that is inserted between the shield conductor and the ground as a dielectric material.

In another embodiment of the present invention, the inner conductors are conductors formed integrally in the ferromagnetic material body. In this case, the additional capacitor preferably includes the shield conductor, the ground and a ceramic material that is inserted between the shield conductor and the ground as a dielectric material.

In a further embodiment of the present invention, the additional capacitor is a capacitor formed integrally with the ferromagnetic material body.

It is preferred that input/output capacitors are formed between input/output ports and the ground, or between input/output ports and the shield conductor.

Further objects and advantages of the present invention will be apparent from the following description of the preferred embodiments of the invention as illustrated in the accompanying drawings.

BEST MODE FOR CARRYING OUT THE INVENTION

Hereinafter, an example of a lumped element type isolator as a preferred embodiment of a non-reciprocal circuit element according to the present invention will be described. Although this embodiment is in a case of the lumped element type isolator, the present invention can be applied to a distributed element type isolator, a lumped element type circulator and a distributed element type circulator.

Figure 7:
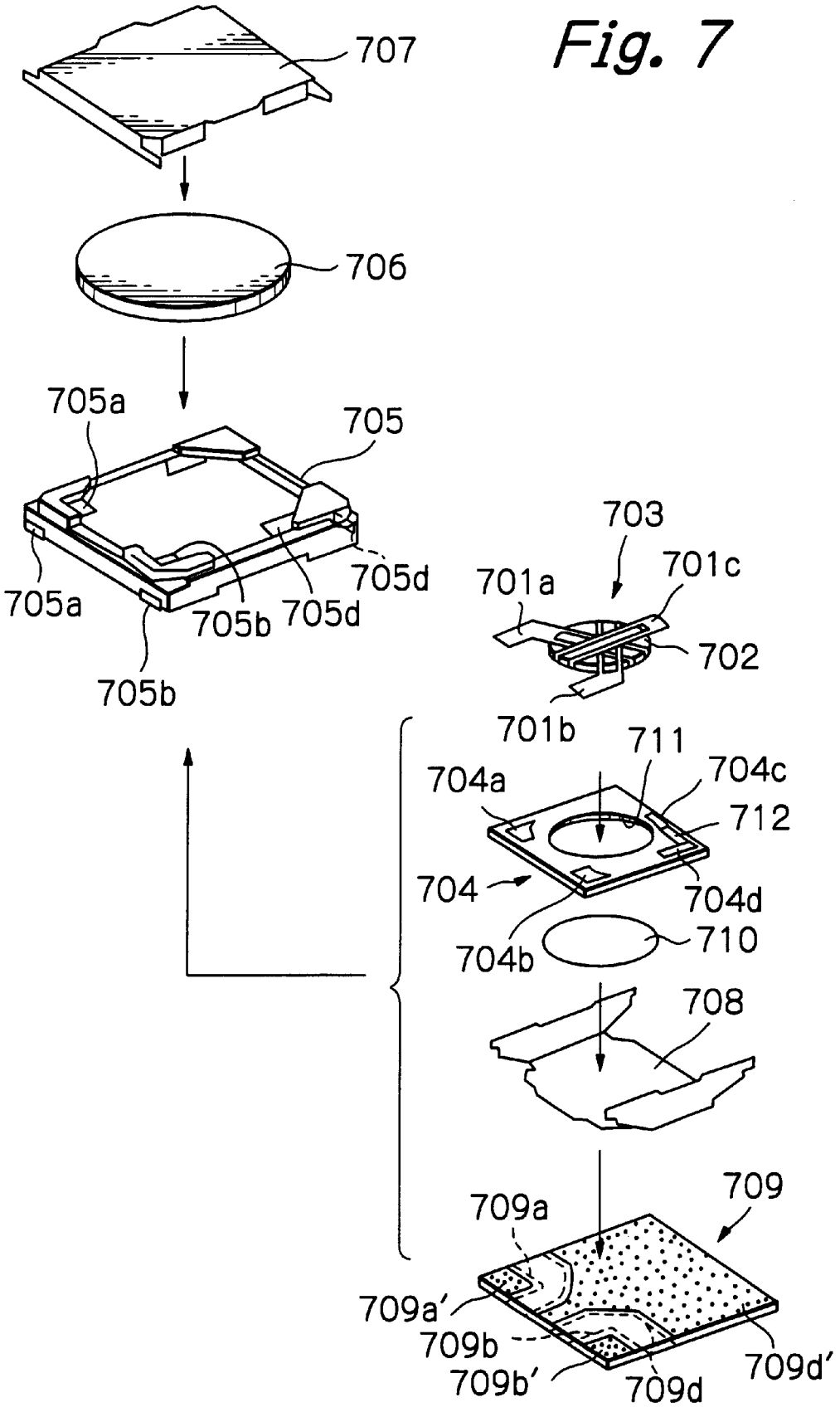
FIG. 7 is an exploded oblique view schematically illustrating whole configuration and assembling order of a lumped element type isolator as a preferred embodiment of a non-reciprocal circuit element according to the present invention.
Figure 8:
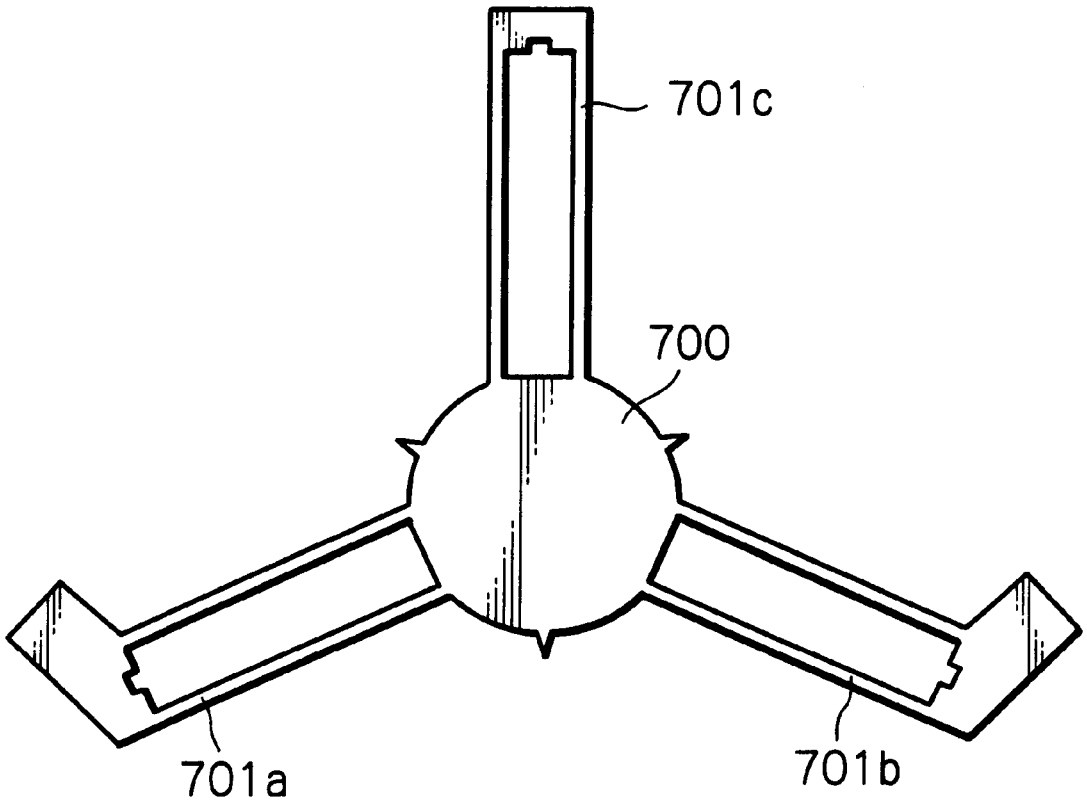
FIG. 8 is a plan view illustrating expanded state before folding with respect to inner conductors and a shield conductor of the embodiment shown in FIG. 7.
Figure 9:
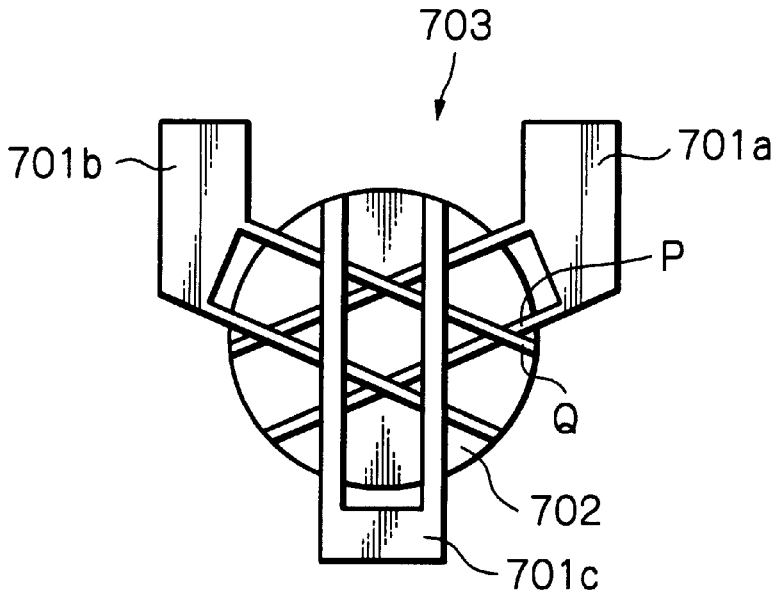
FIG. 9 is a plan view illustrating an assembly constituted by folding the inner conductors of the embodiment shown in FIG. 7 on a ferrite core.
Figure 10:
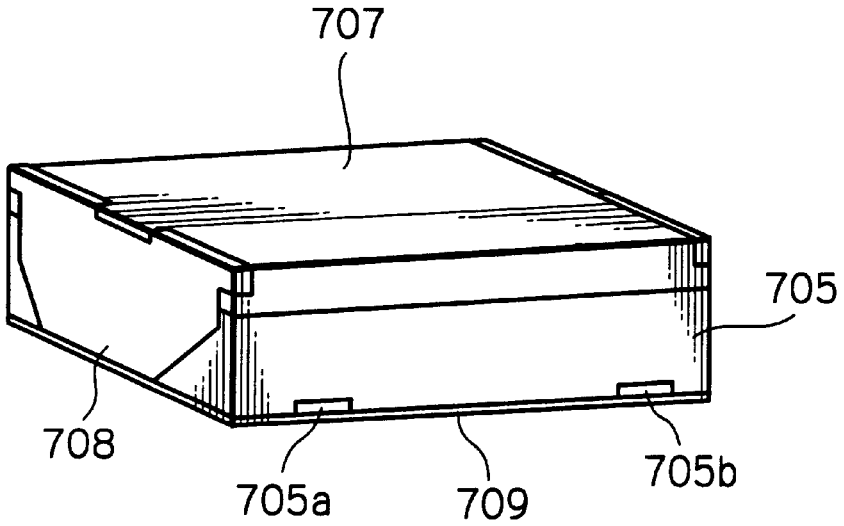
FIG. 10 is an oblique view illustrating an assembled lumped element type isolator of the embodiment shown in FIG. 7.

FIG. 7 is an exploded oblique view schematically illustrating whole configuration and assembling order of the lumped element type isolator as a preferred embodiment of a non-reciprocal circuit element according to the present invention, FIG. 8 is a plan view illustrating expanded state before folding with respect to inner conductors and a shield conductor of the embodiment shown in FIG. 7, FIG. 9 is a plan view illustrating an assembly constituted by folding the inner conductors of the embodiment shown in FIG. 7 on a ferrite core, and FIG. 10 is an oblique view illustrating the assembled lumped element type isolator of the embodiment shown in FIG. 7.

In these figures, reference numeral 700 denotes a shield conductor (shield plate), 701*a*, 701*b* and 701*c* denote strip lines which constitute the three inner conductors, and 702 denotes the circular plate shaped ferrite core made of YIG, respectively.

The shield conductor 700 and the strip lines 701*a*, 701*b* and 701*c* are formed by stamping of a copper foil, as shown in FIG. 8, so that the three strip lines 701*a*, 701*b* and 701*c* are elongated and protruded from the shield conductor 700 in radial directions. The end portions of the strip lines 701*a* and 701*b* are used as input/output terminals and the end portion of the strip line 701*c* is terminated. As shown in FIGS. 7 and 9, the shield conductor 700 (FIG. 8)is formed in a circular shape with substantially the same size as that of the ferrite core 702 disposed thereon.

The assembly 703 consisting of the strip lines as for the three inner conductors and the circular ferrite core is formed as follows. First, the circular ferrite core 702 is disposed on the shield conductor 700. Thereafter, one of strip lines 701*a* and 701*b* with the input/output terminals is folded along the peripheral edge of the ferrite core 702, and then the other one is also folded. Finally, the strip line 701*c* with the terminal to be connected to a terminating resistance along the peripheral edge of the ferrite core 702. Thus, as shown in FIGS. 7 and 9, the assembly 703 with three strip lines 701*a*, 701*b* and 701*c* folded on the upper face of the circular ferrite core 702 to cross with each other is formed.

Although it is not shown in the figures, when the strip lines 701*a*, 701*b* and 701*c* are folded on the circular ferrite core 702, insulating sheets made of polyimide material are inserted between the strip lines 701*a*, 701*b* and 701*c* to make electrical insulation among them.

As will be understood from FIGS. 7 and 10, the lumped element type isolator has, other than the assembly 703, an inner substrate 704 with the terminating resistor and necessary capacitors, a resin housing 705 shaped in a rectangular frame, a permanent magnet 706 for applying DC magnetic field to the assembly 703 in the thickness direction of the ferrite core 702, upper and lower covers 707 and 708 attached in integral to the resin housing 705 to cover upper and lower sides of the housing 705, which operate as soft magnetic yokes, a terminal substrate 709 used for plane-mounting, and an insulating sheet 710 for forming an additional capacitor (capacitance value of Cs) according to the present invention, which will adjust only eigen values of in-phase excitation.

The dielectric insulating sheet 710 is inserted between the assembly 703 and the lower cover 708 so as to form the additional capacitor with the capacitance value Cs, in which the shield conductor 700 of the assembly 703 and the under cover 708 operate, as capacitor electrodes. The insulating sheet 710 can be made of any dielectric material other than resin material such as polyimide.

The inner substrate 704 made of dielectric material has a through hole 711 at its center portion for holding the assembly 703 inserted therein. On the top face of the substrate 704, capacitor electrodes 704*a*, 704*b* and 704*c* with predetermined shapes, to which the end portions of the strip lines 701*a*, 701*b* and 701*c* are electrically connected, and a shield electrode 704*d* are formed. On the top face, furthermore, a terminating resistor 712 made of for example ruthenium oxide is formed by a thick-film printing. The terminating resistor 712 is connected between the capacitor electrode 704*c* connected with the end portion of the strip line 701*c* and the shield electrode 704*d*. Although it is not shown in the figures, next to the bottom face of the substrate 704, a ground electrode that forms input/output capacitors between it and the capacitor electrodes 704*a*, 704*b* and 704*c* is formed. This ground electrode is directly grounded.

The assembly 703 is fitted in the hole 711 of the substrate 704 and then the end portions of the strip lines 701*a*, 701*b* and 701*c* are electrically connected to the capacitor electrodes 704*a*, 704*b* and 704*c* on the substrate 704, respectively.

The inner substrate 704 with the fitted assembly 703 is disposed on the lower cover 708 made of soft magnetic metal material such as iron via the insulating sheet 710.

The rectangular frame shaped housing 705 has two connection electrodes 705*a* and 705*b* at positions corresponding to the end portions or input/output terminals of the two strip lines 701*a* and 701*b*, respectively. The housing 705 also has a ground connection electrode 705*d* for grounding one end of the terminating resistor 712, at a position of the ground electrode 704*d*. To the bottom side of the resin housing 705, the under cover 708 with the assembly 703 attached thereto is assembled. Soldering to the inner end portions of the connection electrodes 705*a* and 705*b* respectively connects the end portions of the strip lines 701*a* and 701*b* and also the capacitor electrodes 704*a* and 704*b*. Soldering to the inner end portion of the ground connection electrode 705*d* connects the ground electrode 704*d*.

The permanent magnet 706 is fixed in the upper cover 707 made of soft magnetic metal material such as iron. The upper cover 707 containing the permanent magnet 706 is assembled on the resin housing 705, and the upper cover 707 and the lower cover 708 are caulked with each other to make them in one piece. Thus, the permanent magnet 706 and the ferrite core 702 with the strip lines 701*a*, 701*b* and 701*c* formed thereon are arranged inside and surrounded by a magnetic yoke constituted by these upper and lower covers 707 and 708.

The terminal substrate 709 has next to its bottom face two plane-mounting terminal electrodes 709*a* and 709*b* used for connection with external circuits at positions corresponding to the input/output terminal end portions of the two strip lines 701*a* and 701*b*, and a ground electrode 709*d*. The terminal substrate 709 also has on its top face electrodes 709*a*' and 709*b*' which are respectively connected to the plane-mounting terminal electrodes 709*a* and 709*b* through via holes (not shown), and an electrode 709*d*' which is connected to the ground electrode 709*d* through a via hole (not shown). This terminal substrate 709 is mounted next to the bottom face of the under cover 708. The electrodes 709*a*' and 709*b*' are connected by soldering to the outer end portions of the connection electrodes 705*a* and 705*b* of the resin housing 705, respectively. The electrode 709*d*' is connected by soldering to the bottom face of the under cover 708.

Thus, the lumped element type isolator in which the input/output terminal end portions of the two strip lines 701*a* and 701*b* are electrically connected to the plane-mounting terminal electrodes 709*a* and 709*b* of the terminal substrate 709, and the end portion of the strip line 701*c* is terminated by being connected to the ground electrode 709*d* through the terminating resistor 712 is provided.

A plurality of samples with the same structure as the above-mentioned lumped element type isolator but with different values of Cs×C were fabricated where C is input/output capacitance. The size of the circular ferrite core 702 is 3.5 mm in diameter and 0.4 mm in thickness.

For these samples, center frequency of isolation, relative intensity of applied bias magnetic field, and changed amount of center frequency of isolation when the temperature varies from −25° C. to 85° C. were measured, respectively. The measured results are indicated in Table 1. For comparison, a sample of the isolator with no additional capacitor was fabricated and the above-mentioned characteristics were also measured (Cs×C=0).

TABLE 1

| Cs × C | Center Frequency of Isolation (MHz) | Applied Magnetic Field | Changed Amount of Center Frequency (MHz) |
|---|---|---|---|
| 0 | 936 | 1.00 | 35 |
| 580 | 892 | 0.99 | 33 |
| 390 | 875 | 0.99 | 33 |
| 50 | 848 | 0.96 | 33 |
| 20 | 830 | 0.95 | 33 |
| 10 | 815 | 0.95 | 33 |

Other samples with the size of the circular ferrite core 702 of 2.5 in diameter and 0.4 mm in thickness were fabricated and similar measurements were executed. The measured results are indicated in Table 2.

TABLE 2

| Cs × C | Center Frequency of Isolation (MHz) | Applied Magnetic Field | Changed Amount of Center Frequency (MHz) |
|---|---|---|---|
| 0 | 1007 | 1.00 | 6.75 |
| 40 | 920 | 0.91 | −5.5 |

As will be apparent from Tables 1 and 2, addition of the capacitor with the capacitance value Cs will present not only lowering of center frequency of isolation and lowering of applied bias magnetic field but also improvement of temperature characteristics of the lumped element type isolator.

The isolation characteristics and temperature characteristics of the non-reciprocal circuit element according to the present invention will be described hereinafter with reference to calculation result in its simulation.

In general, an admittance of in-phase excitation $y_1$, an admittance of positive phase excitation $y_2$ and an admittance of negative phase excitation $y_3$ with respect to a three-port non-reciprocal circuit element can be indicated as:

$$y_1 = j\omega C + \frac{1}{j\omega L_1}$$

$$y_2 = j\omega C + \frac{1}{j\omega L_2}$$

$$y_3 = j\omega C + \frac{1}{j\omega L_3}$$

where C is a parallel resonance capacitance, $L_1$ is an inductance of in-phase excitation, $L_2$ is an inductance of positive phase excitation, and $L_3$ is an inductance of negative phase excitation.

By measuring C $L_1$, $L_2$ and $L_3$, the admittances $y_1$, $y_2$ and $y_3$ can be calculated from these equations, and then isolation characteristics can be calculated from the following equations:

$$s_i = \frac{y_0 - y_1}{y_0 - y_1}$$

$$S_{31} = \tfrac{1}{3}(s_1 + s_2 e^{j2\pi/3} + s_3 e^{-j2\pi/3})$$

where $y_0$ is an eigen admittance of the circuit, s is eigen values of a scattering matrix and $S_{31}$ is isolation.

Figure 1:
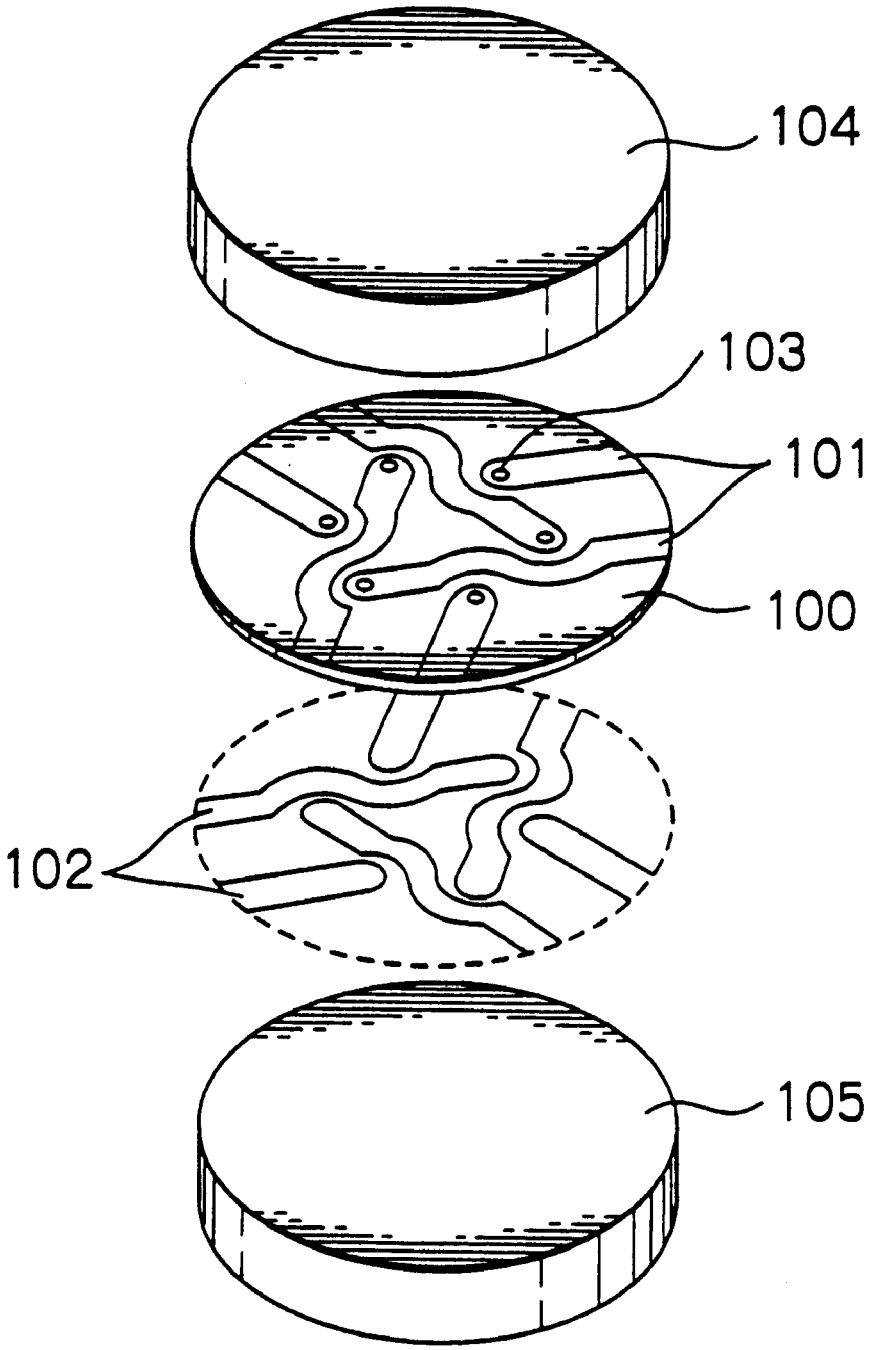
Fig. 1 PRIOR ART
FIG. 1 is an exploded oblique view showing the already described circulator element of the conventional lumped element type circulator.
Figure 2:
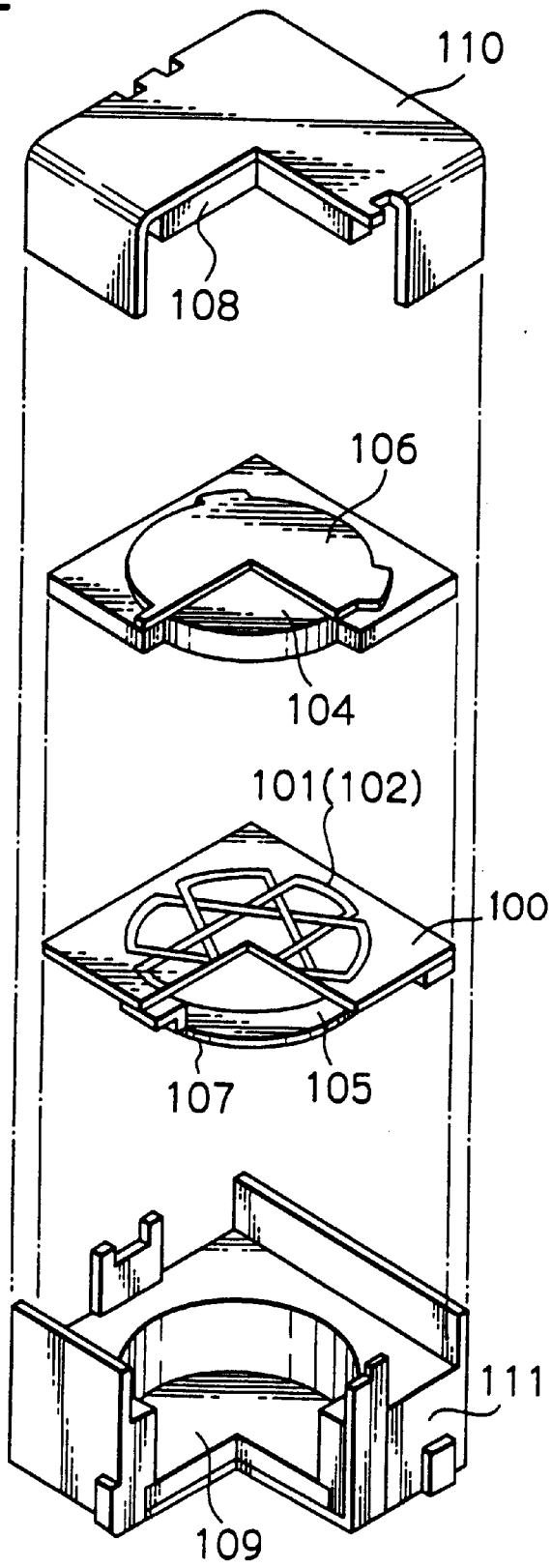
Fig. 2 PRIOR ART
FIG. 2 is an exploded oblique view illustrating the assemble of the already described conventional circulator.
Figure 3:
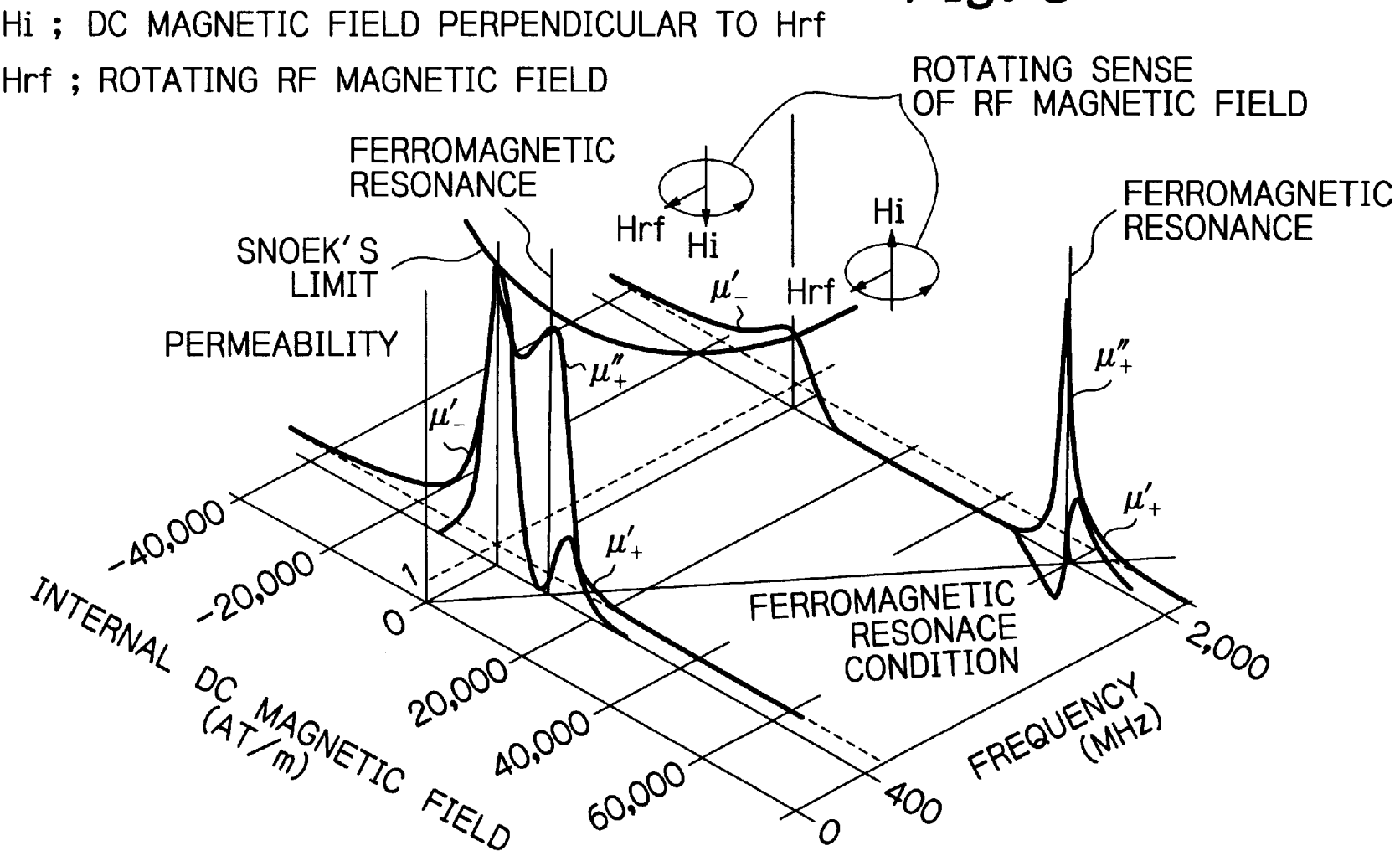
FIG. 3 shows characteristics of gyromagnetic permeability of the ferromagnetic material.
Figure 4:
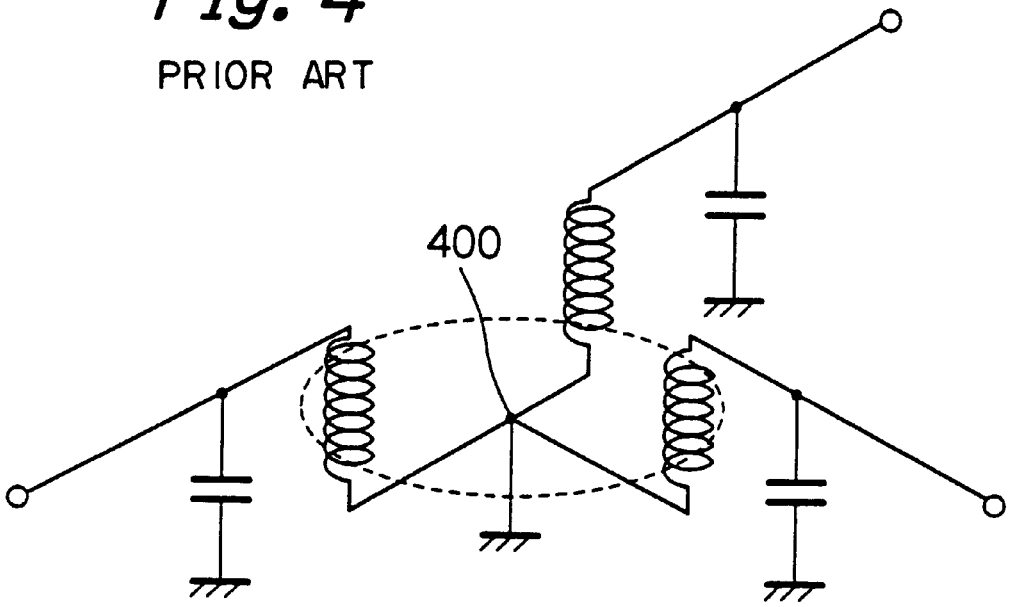
Fig. 4 PRIOR ART
FIG. 4 is an equivalent circuit diagram of the already described conventional circulator.
Figure 5:
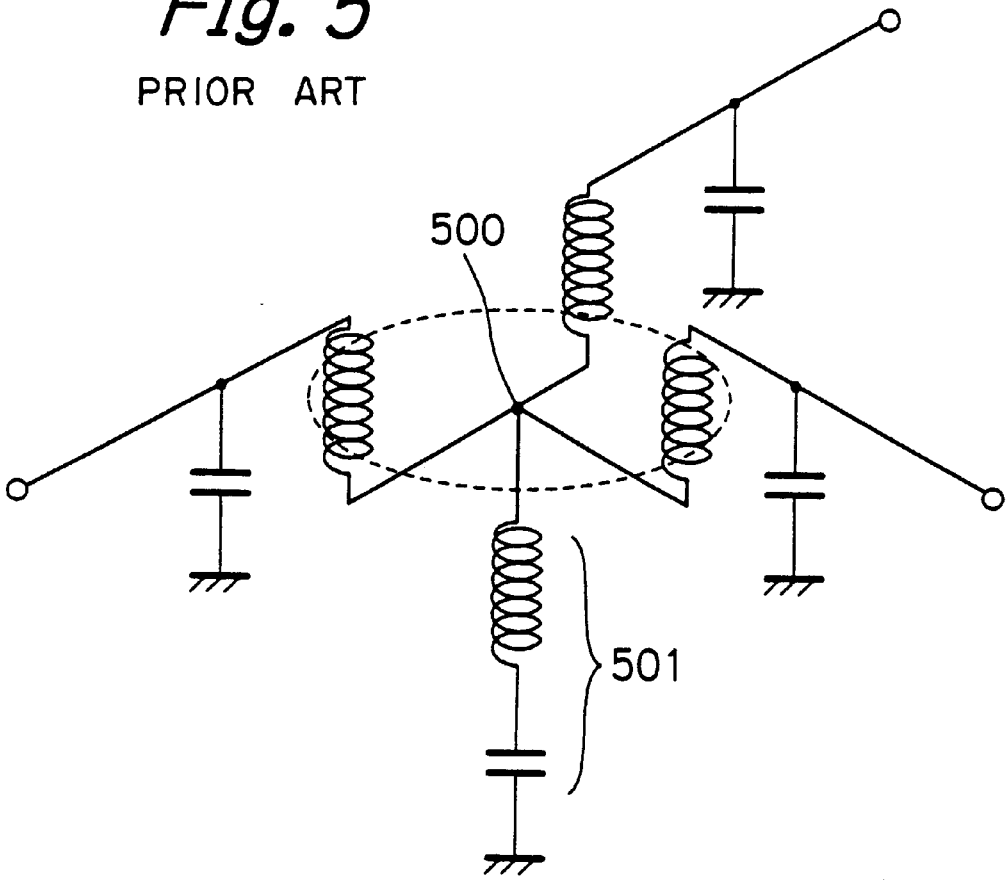
Fig. 5 PRIOR ART
FIG. 5 is an equivalent circuit diagram of the already described conventional circulator with the added serial resonance circuit for adjusting eigen values of in-phase excitation.
Figure 6:
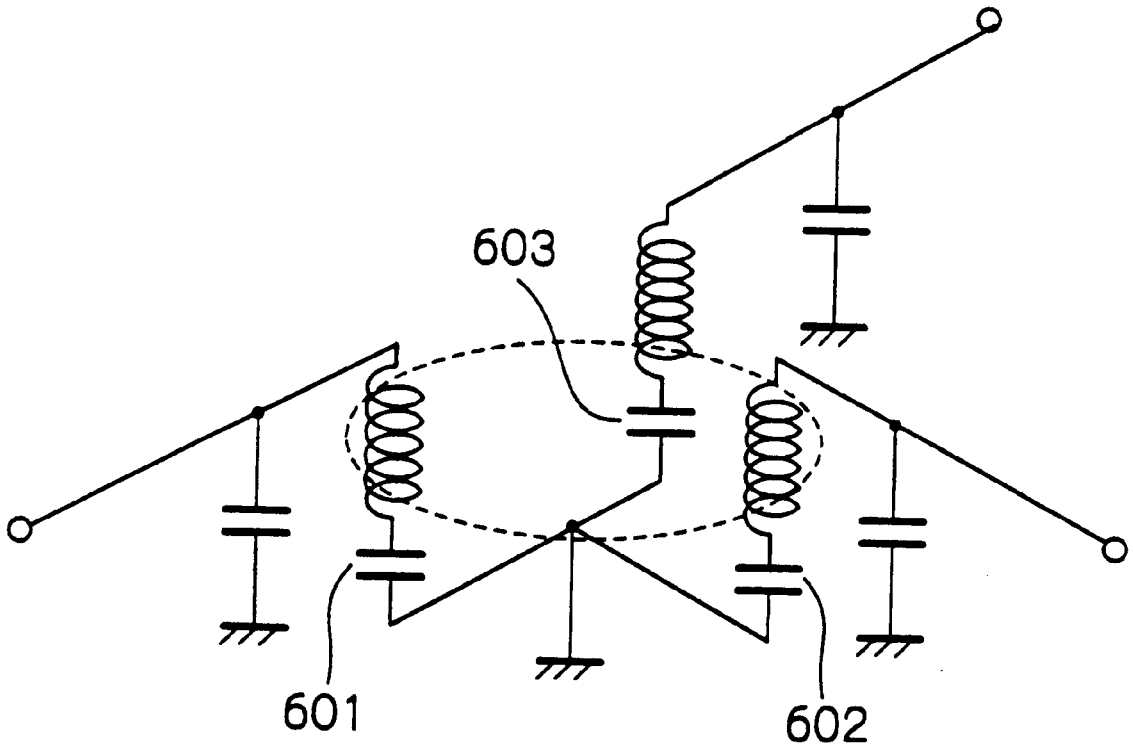
Fig. 6 PRIOR ART
FIG. 6 is an equivalent circuit diagram of the already described conventional circulator described in Japanese Patent Publication No.49(1984)-28219.
Figure 11:
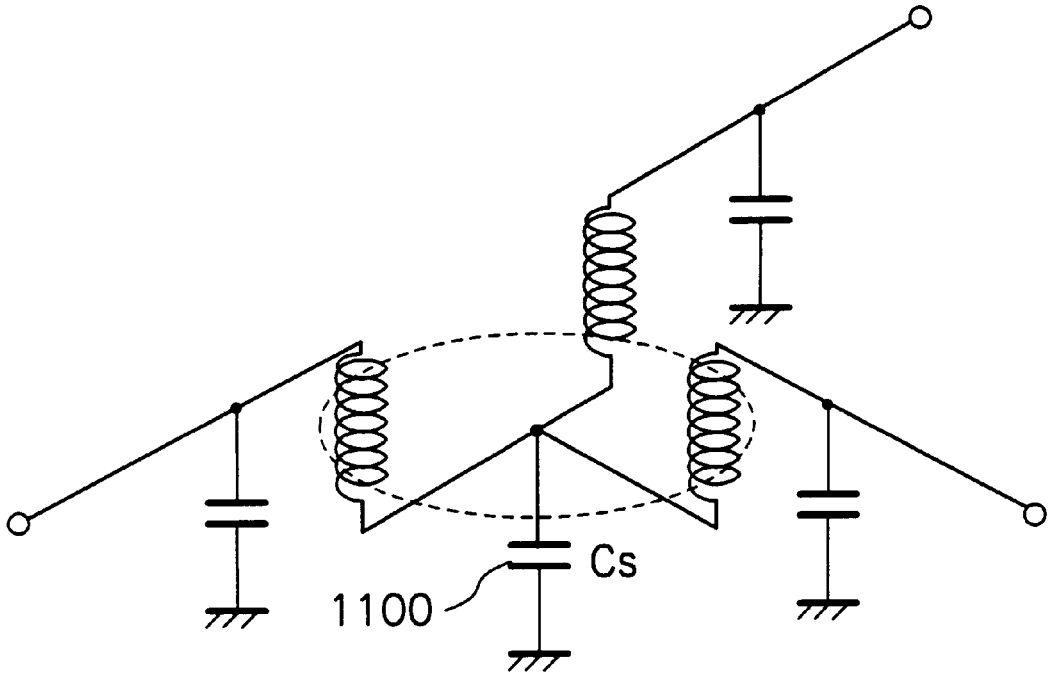
FIG. 11 is an equivalent circuit diagram of the non-reciprocal circuit element of the embodiment shown in FIG. 7.

An equivalent circuit of the non-reciprocal circuit element or the circulator in this embodiment is shown in FIG. 11 in comparison with that of the conventional circulator shown in FIG. 4. As will be apparent by comparing these figures, according to this embodiment, ends of the three inner conductors which consist of three inductors connected together and a capacitor 1100 with a capacitance value Cs for adjusting the eigen values of in-phase excitation is additionally connected between the connected ends of the three inner conductors and the ground. The non-grounded electrode of the capacitance 1100 shown in FIG. 11 corresponds to the shield conductor 700. In this case, the capacitance value Cs acts only the admittance of in-phase excitation and represented as follows.

$$y_1 = j\omega C - j\frac{1}{\omega L_1 - \frac{3}{\omega Cs}}$$

Figure 12:
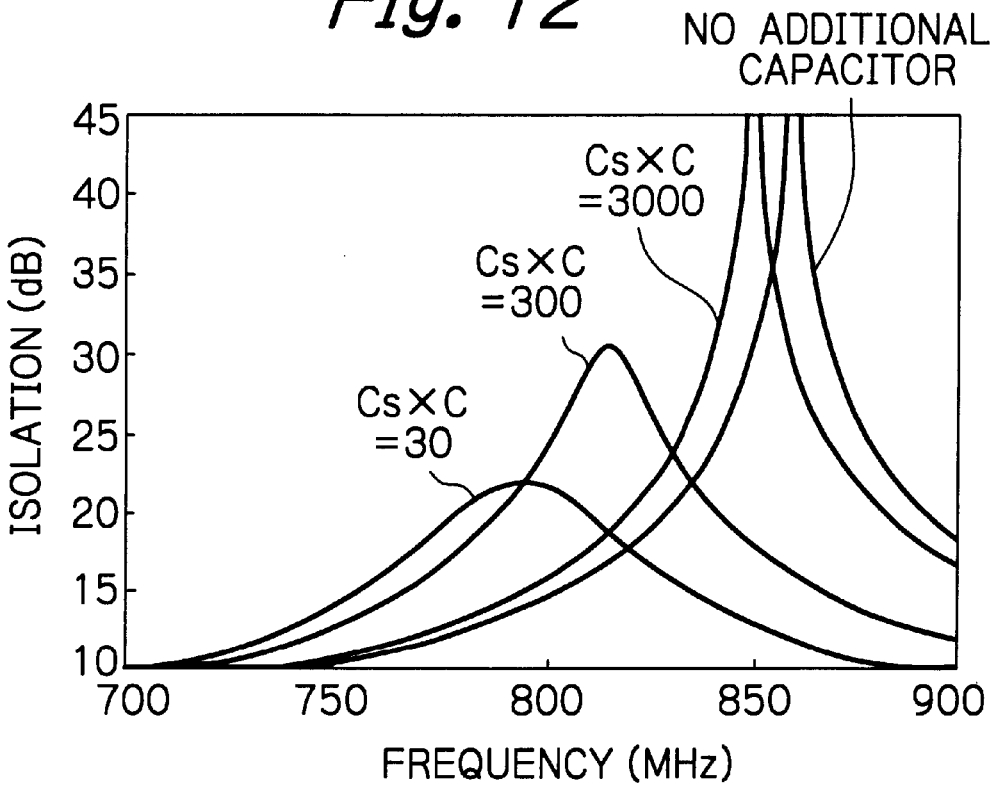
FIG. 12 illustrates isolation characteristics when one of capacitors with various capacitance values Cs is added.

FIG. 12 shows calculation results of isolation characteristics when a capacitance value Cs of the additional capacitor 1100 is varied. The isolation characteristics shown in this figure are calculated from the measured C $L_1$, $L_2$ and $L_3$ in case Cs×C=30, 300 and 3000 [$(pF)^2$] and in case the additional capacitor 1100 is omitted.

As shown in FIG. 12, by forming the additional capacitor 1100 at this position, the center frequency of isolation lowers.

However, in the case of FIG. 12, since the isolation is calculated under assumption that the applied magnetic field is kept constant, the maximum value of each isolation characteristics becomes smaller when the capacitance decreases.

Figure 13:
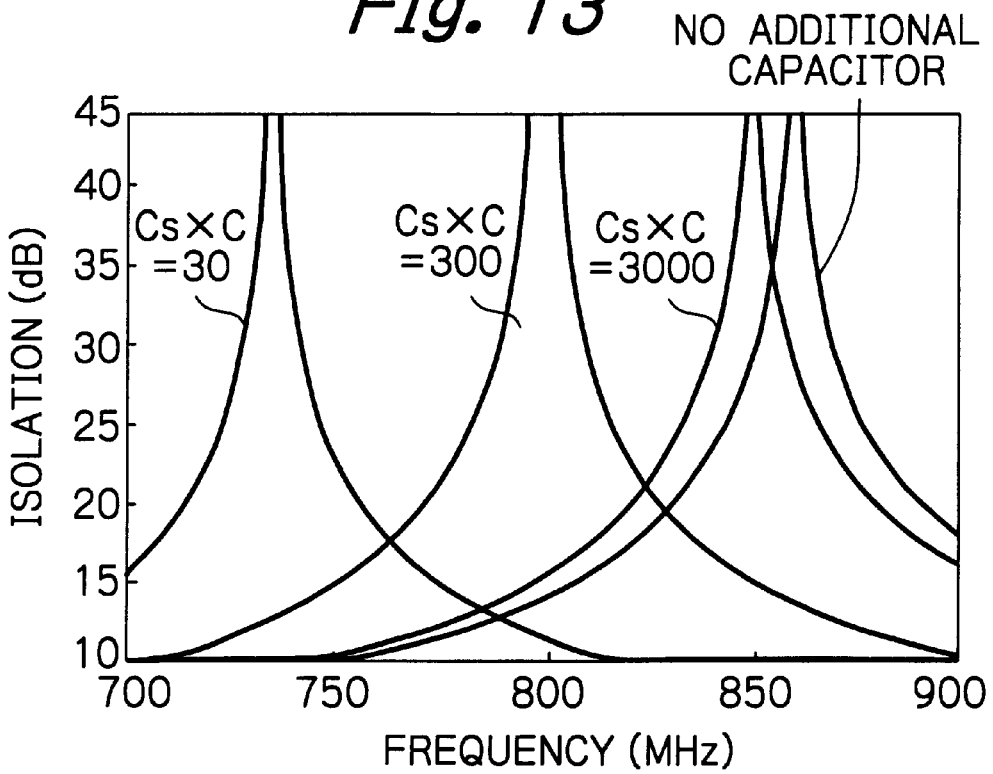
FIG. 13 illustrates isolation characteristics when a capacitor with a capacitance value Cs is added and applied magnetic field is optimized.

FIG. 13 shows calculation results of adjusted isolation characteristics when the applied magnetic field is reduced so that the maximum isolation value of each case becomes its largest value. As will be noted from this figure, by reducing the applied magnetic field, the center frequency of the isolation more lowers.

Figure 14:
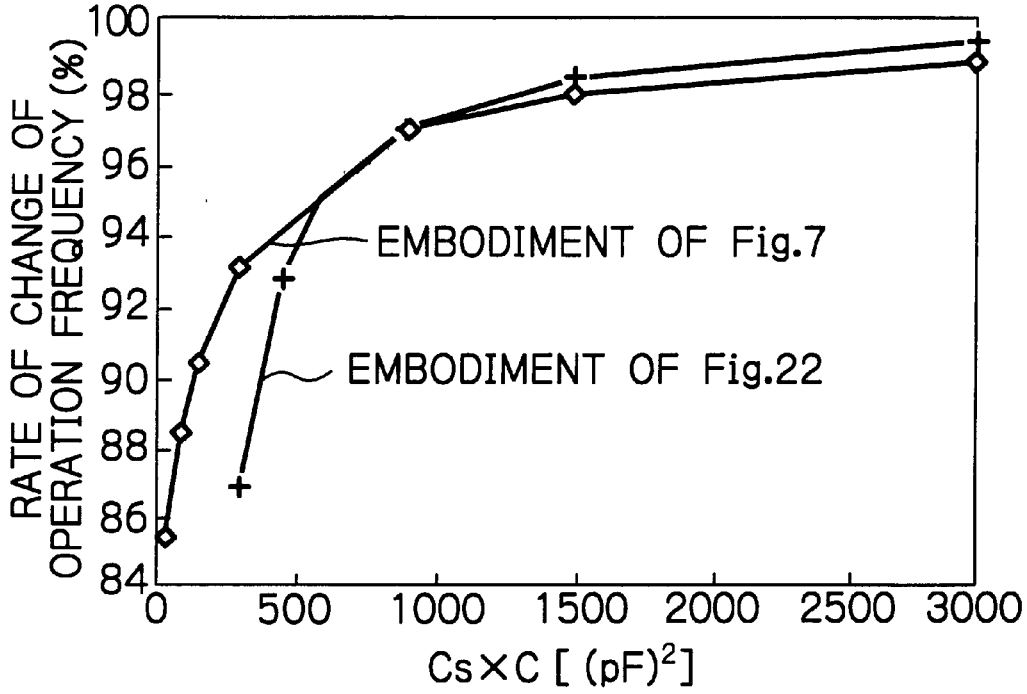
FIG. 14 illustrates change in operation frequency characteristics when the capacitance value Cs is varied.
Figure 15:
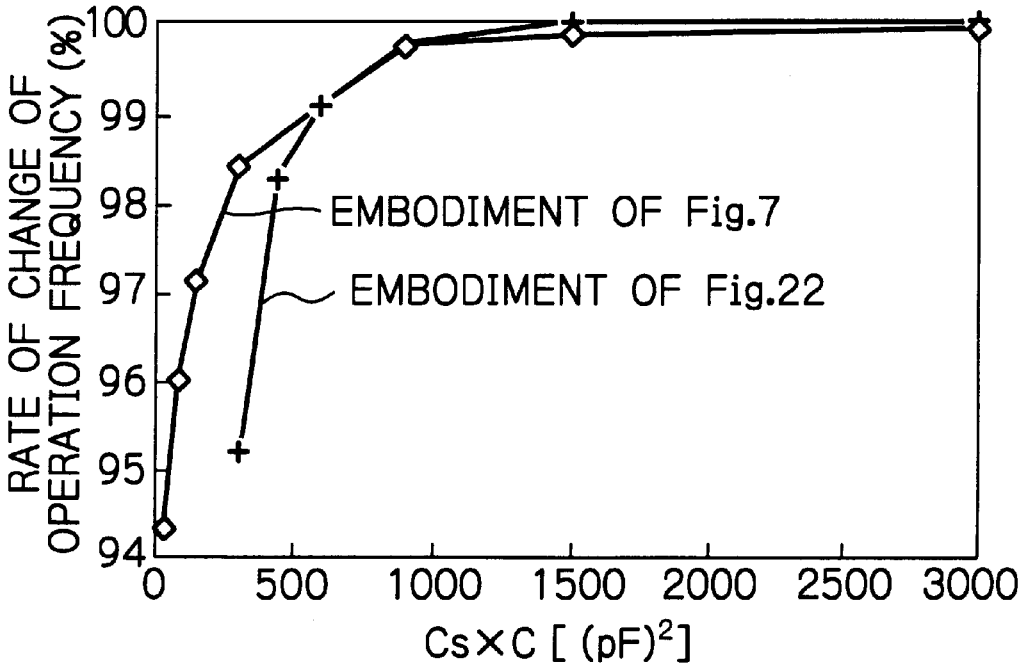
FIG. 15 illustrates change in applied magnetic field characteristics when the capacitance value Cs is varied.

FIG. 14 shows relationship between Cs×C and the center frequency of isolation and FIG. 15 shows relationship between Cs×C and applied magnetic field. These figures illustrates characteristics of not only this embodiment but also another embodiment shown in FIG. 22. As will be apparent from these figures, by adding the capacitor 1100 with the capacitance value Cs, both the operation frequency of the circulator and the magnetic field to be applied thereto can be lowered. It can be noted from FIG. 14 that the operation frequency will greatly lower when Cs×C≦1500 [$(pF)^2$]. Thus, a desired range of Cs×C will be equal to or less than 1500 [$(pF)^2$]. It can also be noted from FIG. 15 that the applied magnetic field will greatly lower when Cs×C≦900 [$(pF)^2$]. Thus, a more desired range of Cs×C will be equal to or less than 900 [$(pF)^2$].

In general, size of the circulator element is inversely proportional to its operation frequency. Namely, if the operation frequency increases, a smaller sized circulator element can be used and therefore downsizing of overall circulator can be expected. In addition, since a smaller sized permanent magnet can be used when the applied magnetic field decreases, the circulator can be further downsized.

Figure 16:
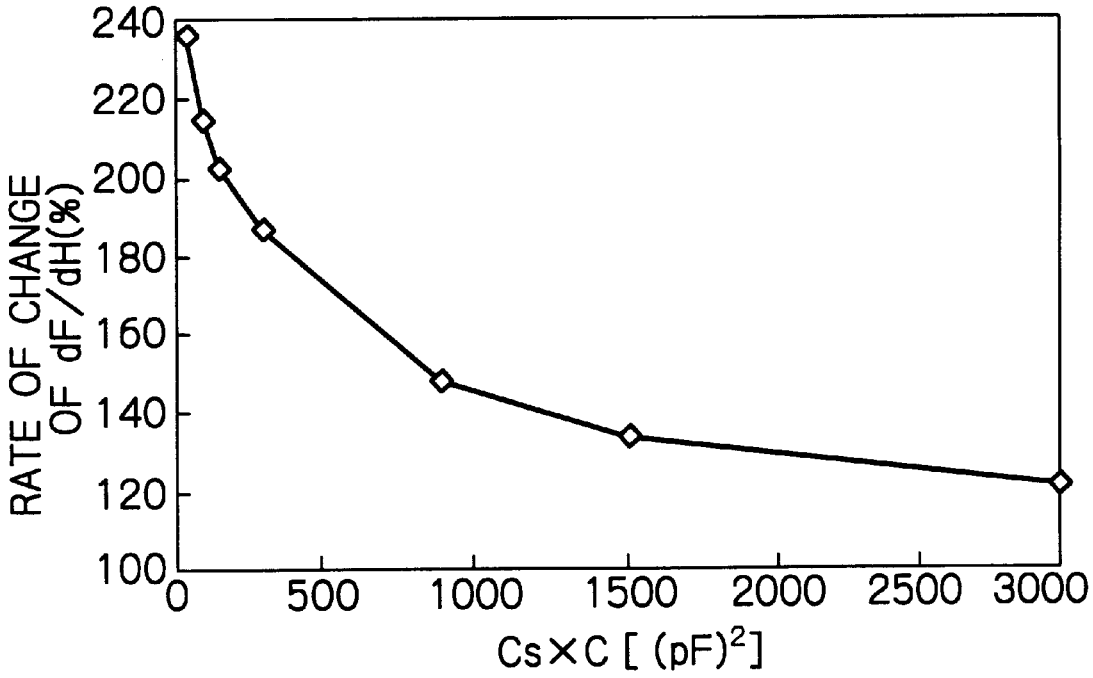
FIG. 16 illustrates change in dF/dH when the capacitance value Cs is varied.

FIG. 16 shows a relationship between Cs×C and amount of frequency change per unit magnetic field dF/dH as a result of calculation of the frequency change when the applied magnetic field and also Cs×C are varied. As will be apparent from the figure, by adding the capacitor 1100 with the capacitance value Cs, dF/dH becomes larger than that when no capacitor is added. The smaller capacitance value Cs will result the larger dF/dH (the amount of change in frequency with respect to the amount of change in applied magnetic field). The dF/dH can be optionally changed by appropriately selecting the value of Cs.

There may be various factors that exert influence upon temperature characteristics of a non-reciprocal circuit element such as a circulator. Two main factors are temperature characteristics of magnetization saturation of the ferromagnetic material such as YIG, utilized in a circuit element and temperature characteristics of the permanent magnet for providing bias magnetic field. Typically, since the temperature characteristics of the ferromagnetic material such as YIG is larger than that of the bias magnetic field, the operation frequency of the conventional circulator will increase when the temperature rises causing the available frequency band to limit in fact.

However, according to the present invention, dF/dH increases by adding the capacitor 1100 with the capacitance value Cs as aforementioned. This means that the temperature characteristics of the circulator is affected more strongly by the temperature characteristics of the bias magnetic field. In other words, according to the present invention, since there occurs an effect as if the temperature characteristics of the bias magnetic field increases, the temperature characteristics of the circulator can be improved. The dF/dH can be optionally changed depending upon the capacitance value Cs. Thus, the temperature characteristics of the circulator can be optionally adjusted by selecting the capacitance value Cs. If the value Cs is determined to an optimum value, a circulator with substantially constant temperature characteristics may be realized.

Figure 17:
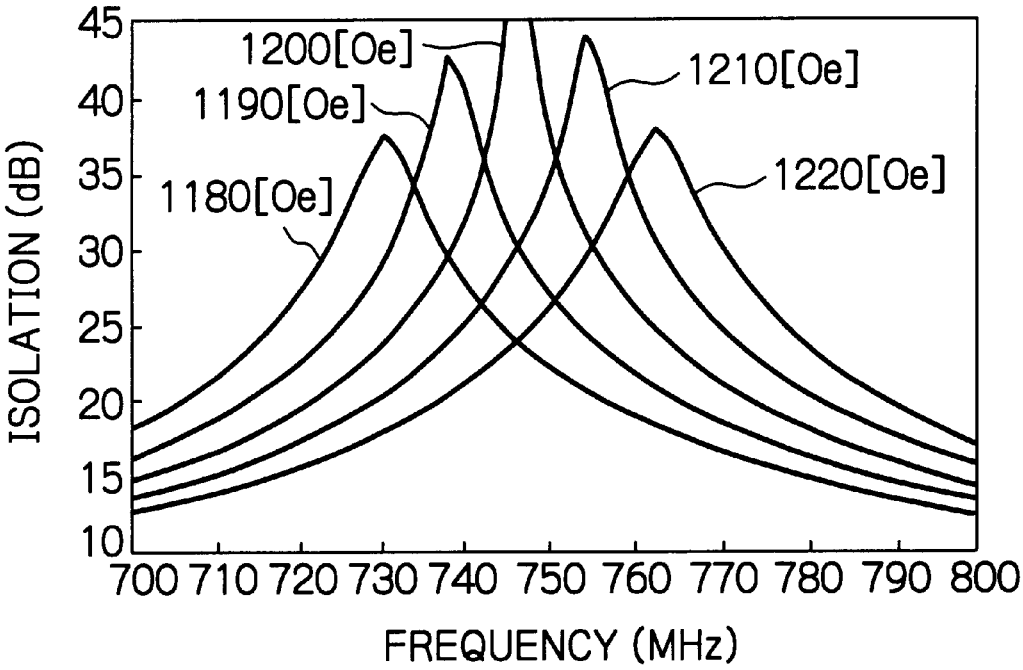
FIG. 17 illustrates change in isolation when a capacitor with a capacitance value Cs=1 pF is added and applied magnetic field is varied.
Figure 18:
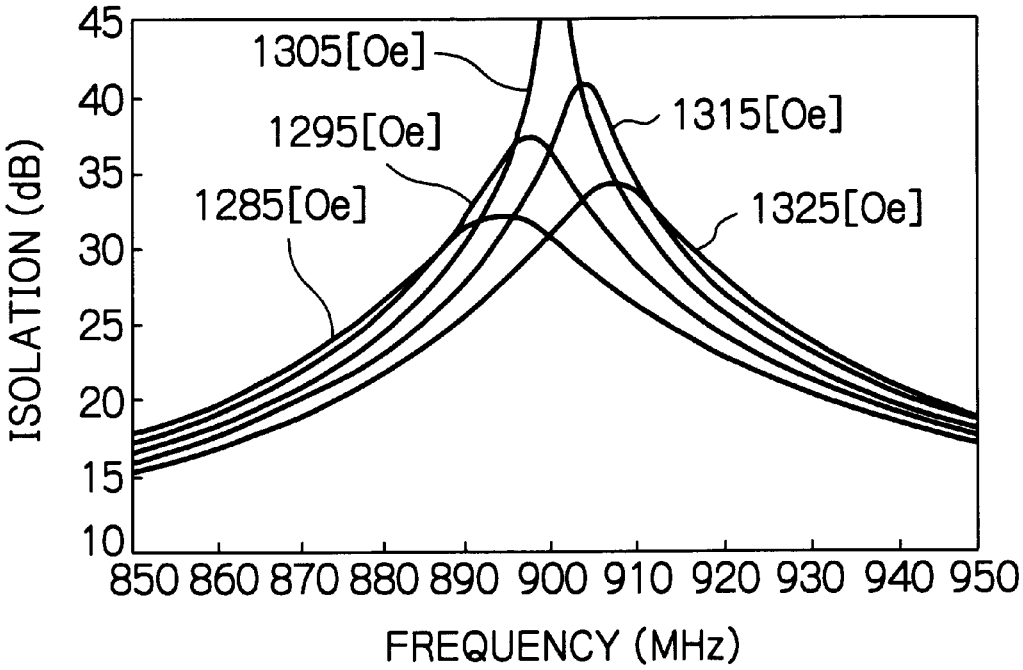
FIG. 18 illustrates change in isolation when no capacitor with a capacitance value Cs is added and applied magnetic field is varied.

FIG. 17 shows isolation characteristics in case a capacitor 1100 with a capacitance value Cs=1 pF is added and applied magnetic field is varied. For comparison, isolation characteristics in case the capacitor 1100 with a capacitance value Cs is not added is shown in FIG. 18. It is understood from these figures that deterioration of the maximum value of the isolation when the capacitor 1100 is added is smaller than that when the capacitor 1100 is not added. Thus, by adding the capacitor 1100 with the capacitance value Cs, deterioration of frequency bandwidth of the isolation can be prevented and also the temperature characteristics of the circulator can be improved.

Figure 19:
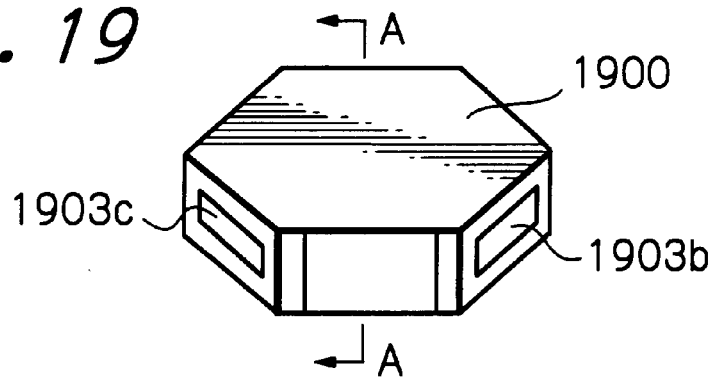
FIG. 19 is an oblique view schematically illustrating configuration of a circulator element part of a lumped element type isolator as another embodiment of a non-reciprocal circuit element according to the present invention.
Figure 20:
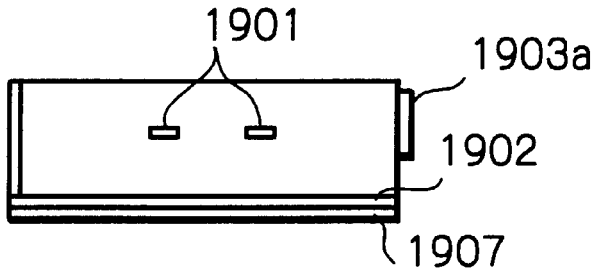
FIG. 20 is an A—A sectional view of FIG. 19.
Figure 21:
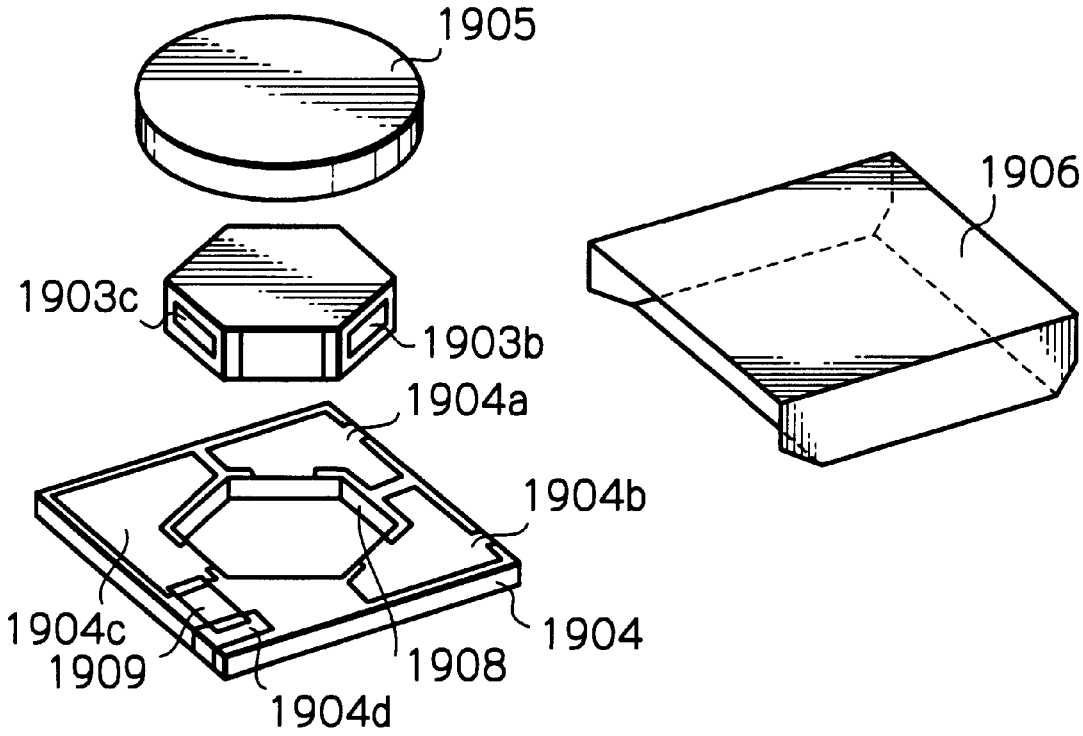
FIG. 21 is an exploded oblique view schematically illustrating whole configuration of the embodiment shown in FIG. 19.

FIG. 19 is an oblique view schematically illustrating configuration of a circulator element part of a lumped element type isolator as another embodiment of a non-reciprocal circuit element according to the present invention, FIG. 20 is an A—A sectional view of FIG. 19, and FIG. 21 is an exploded oblique view schematically illustrating whole configuration of the embodiment shown in FIG. 19. Although this embodiment is in a case of the lumped element type isolator, the present invention can be applied to a distributed element type isolator, a lumped element type circulator and a distributed element type circulator.

In these figures, reference numeral 1900 denotes a circulator element formed by integrating and sintering ferromagnetic material body and inner conductors (center conductors) 1901 with a trigonally symmetric pattern, 1902 denotes a shield conductor formed next to whole bottom face and on a part of the side faces of the circulator element 1900, 1903*a*, 1903*b* and 1903*c* denote terminal electrodes formed on the side faces of the circulator element 1900 and connected to each one of the ends of the respective inner conductors 1901, 1904 denotes an inner substrate, 1905 denotes an exciting permanent magnet, 1906 denotes a yoke made of soft magnetic metal such as iron, and 1907 denotes a dielectric material layer formed next to the bottom face of the shield conductor 1902 for forming an additional capacitor (capacitance value of Cs) according to the present invention, which will adjust only eigen values of in-phase excitation, respectively.

The dielectric material layer 1907 is inserted between the shield conductor 1902 and one face of the yoke 1906 located under the conductor 1902 so as to form the additional capacitor with the capacitance value Cs, in which the shield conductor 1902 of the circulator element 1900 and the one face of the yoke 1906 operate as capacitor electrodes. The dielectric material layer 1907 can be made of any dielectric material other than ceramic.

The inner substrate 1904 made of dielectric material has a through hole 1908 at its center portion for holding the circulator element 1900 inserted therein. On the top face of the substrate 1904, capacitor electrodes 1904*a*, 1904*b* and 1904*c* with predetermined shapes, to which the terminal electrodes 1903*a*, 1903*b* and 1903*c* of the circulator element 1900 are electrically connected, respectively are formed. On the top face, furthermore, a terminating resistor 1909 made of for example ruthenium oxide is formed by a thick-film printing. The terminating resistor 1909 is connected between the capacitor electrode 1904*c* connected with the terminal electrode 1903*c* and a ground electrode 1904*d*. Although it is not shown in the figures, next to the whole bottom face of the substrate 1904, a ground electrode that forms input/output capacitors between it and the capacitor electrodes 1904*a*, 1904*b* and 1904*c* is formed. The capacitor electrodes 1904*a* and 1904*b* also constitute an input terminal and an output terminal, and the ground electrode 1904*d* also constitutes a ground terminal.

Hereinafter, fabrication of the circulator element 1900 will be described in detail. First, yttrium oxide ($Y_2O_3$) material powder and iron oxide material ($Fe_2O_3$) powder are mixed together in a molar ratio of 3:5, and then the mixed powder is calcinated at 1200° C. Thus a ball mill crushes obtained calcination powder, and then ferromagnetic material slurry is fabricated by adding an organic binder and a solvent thereto. Thus obtained ferromagnetic material slurry is formed into green sheets by using a doctor blade. Then, via holes are formed in the green sheet by means of a punching machine. Thereafter, a pattern of the inner conductors 1901 is formed by a conductive material by using a thick-film printing, and simultaneously the via holes are filled by the conductive material. The conductive material used may be silver paste for example.

The green sheets with thus formed inner conductors and via holes are stacked with each other and then the stacked sheets are hot-pressed. And then, the hot-pressed sheets are diced and separated into discrete circulator elements. The separated elements are then sintered at 1480° C.. Baking silver paste next to the whole bottom face of the sintered element forms the shield conductor 1902. The terminal electrodes 1903*a*, 1903*b* and 1903*c*, and connection electrodes for connecting the other ends of the inner conductors with the shield conductor 1902 are also formed by baking silver paste on the side faces of the sintered element. As a result, the circulator element 1900 is completed.

Thereafter, the dielectric material layer 1907 is formed by printing ceramic paste on the face of the shield conductor 1902 of the circulator element 1900 and by firing them.

A lumped element type isolator can be fabricated by assembling the inner substrate 1904, the permanent magnet 1905 and the upper and lower yoke 1906 with thus obtained circulator element 1900 as shown in FIG. 21.

An additional capacitor with a capacitance value Cs is formed by the shield conductor 1902 and one face of the yoke 1906 between which the dielectric material layer 1907 made of ceramic material is sandwiched. The value of Cs×C of this isolator was 50 [$(pF)^2$].

For this sample, center frequency of isolation, relative intensity of applied bias magnetic field, and changed amount of center frequency of isolation when the temperature varies from −25° C. to +85° C. were measured, respectively. The measured results are indicated in Table 3. For comparison, a sample of the isolator with no additional capacitor was fabricated and the above-mentioned characteristics were also measured (Cs×C=0).

TABLE 3

| Cs × C | Center Frequency of Isolation (MHz) | Applied Magnetic Field | Changed Amount of Center Frequency (MHz) |
|---|---|---|---|
| 0 | 883.5 | 1.00 | 14.5 |
| 50 | 802.3 | 0.93 | 6.83 |

As will be apparent from this Table 3, addition of the capacitor with the capacitance value Cs will present not only lowering of center frequency of isolation and lowering of applied bias magnetic field but also improvement of temperature characteristics of the lumped element type isolator as well as in the previous embodiment.

Figure 22:
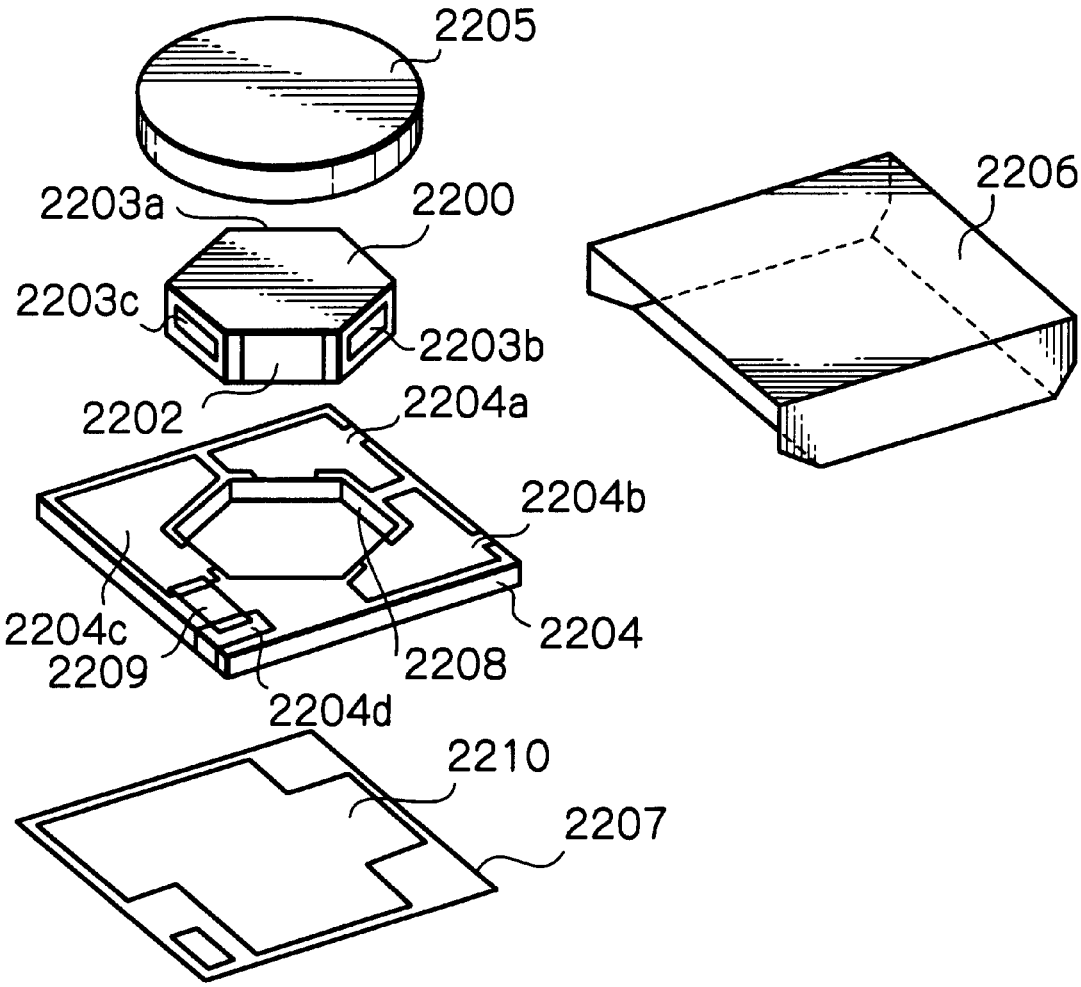
FIG. 22 is an exploded oblique view schematically illustrating whole configuration of a lumped element type isolator as a further embodiment of a non-reciprocal circuit element according to the present invention.

FIG. 22 is an oblique view schematically illustrating configuration of a circulator element part of a lumped element type isolator as a further embodiment of a non-reciprocal circuit element according to the present invention. Although this embodiment is in a case of the lumped element type isolator, the present invention can be applied to a distributed element type isolator, a lumped element type circulator and a distributed element type circulator.

In the figure, reference numeral 2200 denotes a circulator element formed by integrating and sintering ferromagnetic material body and inner conductors (center conductors) with a trigonally symmetric pattern, 2202 denotes a shield conductor formed next to whole bottom face and on a part of the side faces of the circulator element 2200, 2203*a*, 2203*b* and 2203*c* denote terminal electrodes formed on the side faces of the circulator element 2200 and connected to one ends of the respective inner conductors, 2204 denotes an inner substrate, 2205 denotes an exciting permanent magnet, 2206 denotes a yoke made of soft magnetic metal such as iron, 2207 denotes a dielectric material layer formed next to the bottom face of the shield conductor 2202 for forming an additional capacitor (capacitance value of Cs) according to the present invention, which will adjust only eigen values of in-phase excitation, 2210 denotes another shield conductor, respectively. The another shield conductor 2210 is inserted between the shield conductor 2202 formed next to the bottom face of the circulator element 2200 and a shield electrode (not shown) formed next to the bottom face of the inner substrate 2204 so as to connect with the shield conductor 2202 and the shield electrode.

The dielectric material layer 2207 is inserted between the another shield conductor 2210 and one face of the yoke 2206 located under the conductor 2210 so as to form the additional capacitor with the capacitance value Cs, in which the another shield conductor 2210 and the one face of the yoke 2206 operate as capacitor electrodes. The dielectric material layer 2207 can be made of any dielectric material other than ceramics.

The inner substrate 2204 made of dielectric material has a through hole 2208 at its center portion for holding the circulator element 2200 inserted therein. On the top face of the substrate 2204, capacitor electrodes 2204*a*, 2204*b* and 2204*c* with predetermined shapes, to which the terminal electrodes 2203*a*, 2203*b* and 2203*c* of the circulator element 2200 are electrically connected, respectively are formed. On the top face, furthermore, a terminating resistor 2209 made of for example ruthenium oxide is formed by a thick-film printing. The terminating resistor 2209 is connected between the capacitor electrode 2204*c* connected with the terminal electrode 2203*c* and a ground electrode 2204*d*. Although it is not shown in the figure, next to the whole bottom face of the substrate 2204, a shield electrode that forms input/output capacitors between it and the capacitor electrodes 2204*a*, 2204*b* and 2204*c* is formed. The capacitor electrodes 2204*a* and 2204*b* also constitute an input terminal and an output terminal, and the ground electrode 2204*d* also constitutes a ground terminal.

Hereinafter, fabrication of the circulator element 2200 will be described in detail. First, yttrium oxide ($Y_2O_3$) material powder and iron oxide material ($Fe_2O_3$) powder are mixed together in a molar ratio of 3:5, and then the mixed powder is calcinated at 1200° C. Thus a ball mill crushes obtained calcination powder, and then ferromagnetic material slurry is fabricated by adding an organic binder and a solvent thereto. Thus obtained ferromagnetic material slurry is formed into green sheets by using a doctor blade. Then, via holes are formed in the green sheet by means of a punching machine. Thereafter, a pattern of the inner conductors is formed by a conductive material by using a thick-film printing, and simultaneously the via holes are filled by the conductive material. The conductive material used may be silver paste for example.

The green sheets with thus formed inner conductors and via holes are stacked with each other and then the stacked sheets are hot-pressed. And then, the hot-pressed sheets are diced and separated into discrete circulator elements. The separated elements are then sintered at 1480° C.. Baking silver paste next to the whole bottom face of the sintered element forms the shield conductor 2202. The terminal electrodes 2203*a*, 2203*b* and 2203*c*, and connection electrodes for connecting the other ends of the inner conductors with the shield conductor 2202 are also formed by baking silver paste on the side faces of the sintered element. As a result, the circulator element 2200 is completed.

Thus fabricated circulator element 2200 is attached to the inner substrate 2204, and then the another shield conductor 2210 which is connected to the whole shield electrode and to the shield electrode formed next to the bottom face of the inner substrate 2204 and the dielectric material layer 2207 is stacked in this order. Thereafter, by assembling the permanent magnet 2205 and the upper and lower yoke 2206 with them as shown in FIG. 22, a lumped element type isolator can be fabricated.

An additional capacitor with a capacitance value Cs is formed by the shield conductor 2210 and one face of the yoke 2206 between which the dielectric material layer 2207 made of ceramic material is sandwiched.

Figure 23:
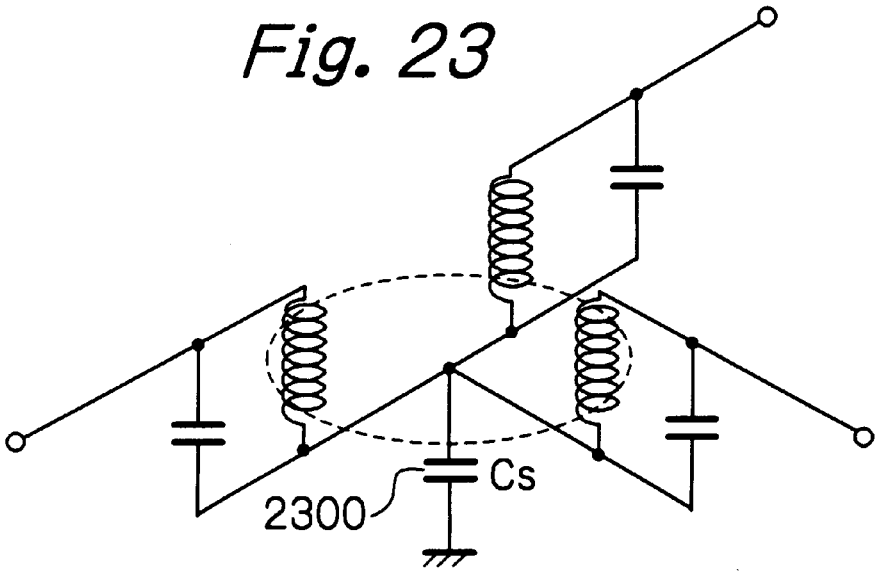
FIG. 23 is an equivalent circuit diagram of the non-reciprocal circuit element of the embodiment shown in FIG. 22.

FIG. 23 shows an equivalent circuit diagram of the non-reciprocal circuit element (isolator) of this embodiment shown in FIG. 22.

One end of the three inner conductors which consist of three inductors connected together and a capacitor 2300 with a capacitance value Cs for adjusting the eigen values of in-phase excitation is additionally connected between the connected ends of the three inner conductors and the ground. In this case, the capacitance value Cs acts only the admittance of in-phase excitation and represented as follows.

$$y_1 = \frac{j}{\frac{3}{\omega C_s} + \frac{1}{\omega C - \frac{1}{\omega L_1}}}$$

In this embodiment, one electrode of the input/output capacitors are not directly grounded but connected to the another shield conductor 2210, and therefore one electrodes of the input/output capacitors are grounded via the additional capacitor 2300. Ungrounded electrode of the additional capacitor 2300 shown in FIG. 23 corresponds to the another shield conductor 2210 and the above-mentioned one electrode connected thereto.

As will be apparent from FIGS. 14 and 15, by adding the capacitor 2300 with the capacitance value Cs, both the operation frequency of the circulator and the magnetic field to be applied thereto can be lowered. It can be noted from FIG. 14 that the operation frequency will greatly lower when $Cs \times C \leqq 1500$ [$(pF)^2$]. Thus, a desired range of Cs×C will be equal to or less than 1500 [$(pF)^2$]. It can also be noted from FIG. 15 that the applied magnetic field will greatly lower when $Cs \times C \leqq 900$ [$(pF)^2$]. Thus, a more desired range of Cs×C will be equal to or less than 900 [$(pF)^2$].

Addition of the capacitor with the capacitance value Cs will present not only lowering of center frequency of isolation and lowering of applied bias magnetic field but also improvement of temperature characteristics of the lumped element type isolator as well as in the previous embodiment.

Many widely different embodiments of the present invention may be constructed without departing from the spirit and scope of the present invention. It should be understood that the present invention is not limited to the specific embodiments described in the specification, except as defined in the appended claims.

As described in detail, according to the present invention, since a capacitor is connected between a shield conductor which is commonly connected to one ends of inner conductors and an ground, for adjusting only eigen values of in-phase excitation, both center frequency of isolation and applied bias magnetic field can be simultaneously decreased. By lowering the operation frequency, a smaller sized circulator element can be used. As a result, a non-reciprocal circuit element with smaller size, lighter weight and lower height can be realized. In addition, by lowering operation magnetic field, a smaller sized permanent magnet can be used, resulting further downsizing of the non-reciprocal circuit element to realize. Furthermore, since such effects can be obtained by merely adding a capacitor, downsizing of the non-reciprocal circuit element will be expedited.

Selecting the capacitance value of this additional capacitor can optionally change the amount of frequency change per unit of magnetic field dF/dH. If dF/dH increases, the temperature characteristics of the non-reciprocal circuit element are affected more strongly by the temperature characteristics of the bias magnetic field and thus there occurs an effect as if the temperature characteristics of the bias magnetic field increase. As a result, the temperature characteristics of the circulator can be improved. The dF/dH can be optionally changed depending upon the capacitance value of the additional capacitor. Thus, the temperature characteristics of the circulator can be optionally adjusted by selecting the capacitance value. If the capacitance value is determined to an optimum value, a circulator with substantially constant temperature characteristics may be realized. In other words, temperature characteristics can be optionally adjusted without changing material used and without inviting increased insertion loss.

What is claimed is:

1. A non-reciprocal circuit element comprising:

a ferromagnetic material body;

a plurality of inner conductors intersecting such that they remain insulated from each other, said inner conductors being formed on or in said ferromagnetic material body;

a permanent magnet for applying a magnetic field to said ferromagnetic material body;

a shield conductor connected in common to one end of said inner conductors;

input/output ports connected to the other ends of said inner conductors;

input/output capacitors formed directly between said respective input/output ports and a around of the non-reciprocal circuit element; and a capacitor connected between said shield conductor and said ground, for adjusting only eigen values of in-phase excitation so as to lower an operation frequency of the non-reciprocal circuit element.

2. The non-reciprocal circuit element as claimed in claim 1, wherein said inner conductors consist of strip lines folded on said ferromagnetic material body.

3. The non-reciprocal circuit element as claimed in claim 1, wherein said inner conductors consist of conductors formed integrally in said ferromagnetic material body.

4. The non-reciprocal circuit element as claimed in claim 1, wherein said capacitor includes said shield conductor, said ground and a resin material which is inserted between said shield conductor and said ground as a dielectric material.

5. The non-reciprocal circuit element as claimed in claim 1, wherein said capacitor includes said shield conductor, said ground and a ceramic material which is inserted between said shield conductor and said ground as a dielectric material.

6. The non-reciprocal circuit element as claimed in claim 1, wherein said capacitor consists of a capacitor formed Integrally with said ferromagnetic material body.

7. The non-reciprocal circuit element as claimed in claim 1, wherein said capacitor consists of a capacitor with a capacitance value of Cs which satisfies $Cs \times C \leqq 900$ ($pF^2$).

8. A non-reciprocal circuit element comprising:

an upper cover;

a permanent magnet arranged next to said upper cover;

a resin housing for receiving said permanent magnet and attached to said upper cover;

an assembly arranged next to said resin housing and comprising strip lines and a shield conductor, said strip lines being folded on a ferrite core located on said shield conductor, one end of said strip lines being connected in common to said shield conductor;

input/output ports connected to the other ends of said strip lines;

an inner substrate arranged next to said assembly opposite said resin housing and having capacitor electrodes located on a surface thereon, said capacitor electrodes being connected to said input/output ports to form input/output capacitors directly connected between said respective input/output ports and a ground of the non-reciprocal circuit element;

an insulating sheet arranged against said substrate and said shield conductor; and a lower conductive cover arranged next to said insulating sheet and attached to said resin housing on a side opposite the upper cover to form a capacitor connected between said shield conductor and said ground, for adjusting only eigen values of in-phase excitation so as to lower an operation frequency of the non-reciprocal circuit element.

* * * * *

UNITED STATES PATENT AND TRADEMARK OFFICE

CERTIFICATE OF CORRECTION

PATENT NO. : 6,215,371 B1
DATED : April 10, 2001
INVENTOR(S) : Takahide Kurahashi et al.

It is certified that error appears in the above-identified patent and that said Letters Patent is hereby corrected as shown below:

Please change the following:
(22) PCT Filed: "Nov. 11, 1998" to Nov. 13, 1998

Signed and Sealed this

Eighteenth Day of September, 2001

*Attest:*

Nicholas P. Godici

NICHOLAS P. GODICI
*Acting Director of the United States Patent and Trademark Office*

*Attesting Officer*